United States Patent [19]

Bouvin

[11] 4,164,390

[45] Aug. 14, 1979

[54] BURNER FOR LIQUID FUEL

[75] Inventor: Jacques Bouvin, Saint Martin du Vivier, France

[73] Assignee: Esso Societe Anonyme Francaise, Paris, France

[21] Appl. No.: 795,832

[22] Filed: May 11, 1977

[30] Foreign Application Priority Data

May 11, 1976 [FR] France ..... 76 14155

[51] Int. Cl.[2] ..... F23D 5/00

[52] U.S. Cl. ..... 431/75; 431/28; 431/208

[58] Field of Search ..... 431/28, 39, 75, 208; 48/103, 180 H

[56] References Cited

U.S. PATENT DOCUMENTS

| | | | |
|---|---|---|---|
| 1,555,631 | 9/1925 | Brown | 431/208 X |
| 1,687,148 | 10/1928 | Schneider | 431/208 |
| 2,123,884 | 7/1938 | Faverty | 48/107 X |
| 2,300,968 | 11/1942 | Reichelm | 431/208 X |
| 2,473,347 | 6/1949 | Sanborn | 431/208 X |

FOREIGN PATENT DOCUMENTS 2257063 8/1975 France .

*Primary Examiner*—Robert G. Nilson
*Attorney, Agent, or Firm*—F. Donald Paris

[57] ABSTRACT

A burner for burning a liquid hydrocarbon fuel at low outputs (no more than 50 kw) comprises a vaporizer to which liquid fuel is supplied and in which fuel is vaporized at autogeneous pressure, and means operative to furnish a flow of air at atmospheric pressure which sweeps fuel vapor escaping from the vaporizer to a burner head where the air-fuel vapor mixture is burned. The vaporizer operates independently of the conditions at the burner head, and the ratio of air to fuel vapor passed to the head is automatically maintained stoichiometric. The vaporizer is constructed to avoid fuel decomposition, and the fuel supply is arranged to ensure operating stability. Means to avoid fuel vapor emission at start-up and shut-down are provided.

15 Claims, 11 Drawing Figures

FIG. 5.
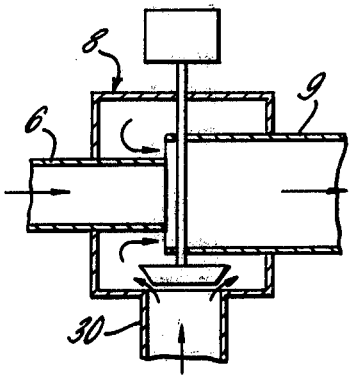
FIG. 6.
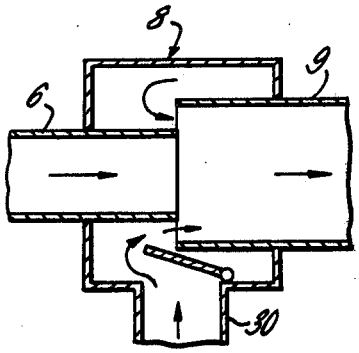
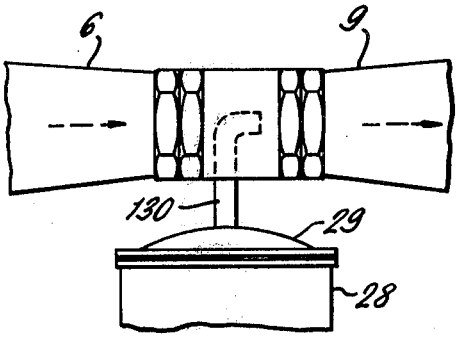
FIG. 7.
FIG. 8.
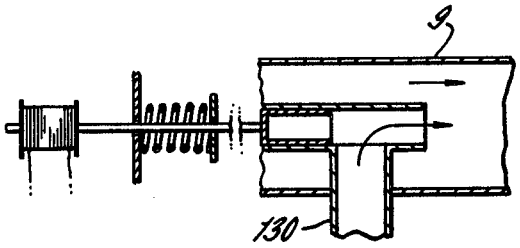
FIG. 9.
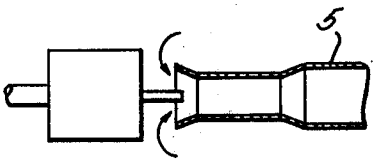
FIG. 10.
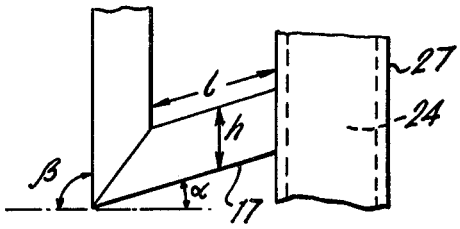

BURNER FOR LIQUID FUEL

The present invention relates to a burner for liquid fuel, and relates more particularly to a burner in which liquid fuel is vapourized and mixed with combustion-supporting air, the resulting mixture being burned for the production of heat.

Burners of this type are known. For example, in French Pat. No. 2,257,063 fuel is heated and vapourized in an upwardly-extending tube, the vapours separated from the unvapourized liquid in a chamber above the tube, the liquid being recovered from the chamber in a downwardly extending tube which receives, in addition, a feed of cold liquid fuel, and which communicates at its bottom with the upwardly-extending tube. The fuel vapour is sucked out of the chamber by entrainment in combustion air passing through an ejector which communicates the reduced pressure in its jet pump to the fuel vapourizer thereby reducing the fuel boiling temperature. A drawback of this burner is that the air supplied to the ejector must be at a relatively high pressure to suck the fuel vapour effectively from the fuel vapourizer and to overcome the back pressure of the ejector. Accordingly, a relatively noisy air supply fan must be used. Another drawback of this type of burner is that it has been observed that the vapourization of the fuel does not proceed in a uniform manner and that accordingly, the size and appearance of the flame tends to vary.

In another burner of this type described in U.S. Pat. No. 2,123,884, air at a relatively high pressure is employed to generate a low pressure in an ejector so as to entrain vapourized fuel from a vapourizing chamber, the air and fuel vapour being mixed on passing through the divergent diffuser of the ejector where the kinetic energy is at least partly converted to pressure energy, and some of the mixture is recirculated to the vapourizing chamber from the downstream end of the diffuser, after combustion, in order to convert liquid fuel to fuel vapour. This burner also is noisy since a relatively high pressure blower must be employed to provide sufficient energy to entrain the fuel vapour, to overcome the back pressure of the ejector and also to furnish sufficient pressure energy to recirculate some of the air-fuel vapour mixture to the vapourizing chamber and to bubble the mixture through liquid fuel in the chamber. Moreover, the control of the flow of fuel vapour must be effected by a throttle valve 26 and no means are provided for automatically securing a particular ratio of air to fuel.

The invention provides a burner for liquid fuel comprising a burner head at which the fuel is burned with air in a substantially stable flame; air supply means operable to supply air at substantially atmospheric pressure; an air supply conduit comprising a divergent diffuser for conducting air from said supply means to the burner head; a vapourizer for converting liquid fuel to fuel vapour out of contact with air or hot gases and at a pressure at least equal to the operating pressure at a selected region of the conduit, the vapourizer comprising liquid fuel heating means operable to vapourize liquid fuel independently of the presence of any flame at the burner head; and a tube for conducting fuel vapour from the vapourizer to the selected region of the conduit.

Preferably the vapourizer has no more than two orifices therein, one orifice being an inlet for the supply of liquid fuel and the other being an outlet for substantially undiluted fuel vapour.

The burner may comprise regulating means for regulating the flow rate of air from said air supply means to said selected region of the conduit, and control means responsive to the rate of supply of fuel vapour to the burner head for adjusting the regulating means whereby to maintain the rate of flow of air in the range of from 80 to 120% of the air required for complete combustion of the fuel vapour passing to the burner head.

The burner may comprise liquid fuel supply equipment comprising a container, means for maintaining a constant level of liquid fuel in the container, and a liquid fuel supply conduit connecting the container to the vapouriser.

As shown in FIG. 10, the liquid fuel supply conduit preferably comprises a first conduit portion of length l and vertical internal diameter h connected at one end of the vapourizer and connected at the other end to one end of a second conduit portion which communicates, at its other end, with the said container, the first conduit portion having a upward slope towards the vapourizer at an angle alpha to the horizontal wherein alpha has a valve not greater than arc sin d/21 and not less than arc sin d/1. The second conduit portion preferably extends upwardly at an angle to the horizontal of at least 45°, and is more preferably substantially vertical.

The constant level means may be constructed and arranged to maintain a level of liquid fuel at least halfway between the top and bottom of the volume for containing liquid in the vapourizer.

The vapourizer preferably comprises a substantially vertical riser conduit side-by-side with a substantially vertical downcomer conduit, the riser conduit and downcomer conduit communicating with each other at or near their bottoms, a disengaging chamber connecting the tops of the riser and downcomer conduits for the disengagement of fuel vapour from liquid fuel, the said tube providing communication between the chamber and the selected region of the air conduit, said heating means defining with the internal wall of the riser conduit a relatively narrow substantially vertical space for the upward circulation of a mixture of liquid and vapourized fuel generated by the action of the heating means, on liquid fuel when in the vapourizer.

In one type of embodiment, the volume of fuel containable by the container may be sufficient for reducing the temperature of liquid fuel in the vapourizer, when mixed with heated fuel in the vapourizer, to a temperature at which substantially no vapour is generated in the vapourizer. The fuel volume of the container may be at least sufficient to fill the vapourizer substantially to the level of the top of the disengaging chamber and there may be means operable for displacing said volume of liquid fuel from the container to the vapourizer.

Alternatively or in addition, there may be valve means operable to close the fuel vapour-conducting tube to prevent the passage of vapour from the vapourizer to the selected region of the air conduit.

The fuel vapour-conducting tube may terminate substantially coaxially with the axis of the selected region of the air supply conduit whereby during operation of the burner, fuel vapour passes into the selected region substantially coaxially thereof.

The air supply means may comprise a low pressure fan or alternatively an air supply pump operative to deliver air at a superatmospheric pressure to an ejector at one end of the air supply conduit whereby to entrain air from outside the said open end into the air supply conduit.

The burner of the invention is particularly intended for and suited to domestic installations for space and water heating in small dwellings, such as apartments, small houses, inter alia, since it is very quiet, efficient and can be manufactured without difficulty to give a heat output in the range of up to 50 KW, preferably 8 to 25 kW, eg 10 to 20 kW. Because the fuel vapour passes to the diffuser under its autogeneous pressure, the air merely sweeps it towards the burner head without the energy losses in ejectors which have to be made up for by high energy, noisy fans.

It is an advantage for the air supply means to be of a type with high specific speed followed by a diffuser or spreader in direct communication with the vaporiser, viz a vaporizer comprising a volume in which the liquid to be vaporised is kept at a largely constant level, and appropriate heating means arranged inside a riser the greater part of whose internal height and volume they occupy, the space between the outer surface of the heating means and the riser wall being sufficiently small so that during vapourization, the rising movement of the vapour bubbles carries along the liquid rapidly and makes it overflow at the top of the riser.

It will readily be appreciated that in the burner of the present invention, the very slight negative pressure that prevails in the diffuser is transmitted to the vaporiser with which it communicates. If this negative pressure is variable, the vaporiser being supplied by a level device with a constant upper level, the level in the vaporiser will undergo slight fluctuations. They are then in this case sufficiently slight no longer to necessitate a pressure balancing line with the constant level device, which constitutes a simplification and ensures stability in operation. Attention must merely be given to ensuring the tightness of the vaporiser/burner connection.

Similarly, the system of return lines to the vaporiser of condensates formed unavoidably during cold starts can be simplified and even eliminated by a suitable profiles and inclinations given to the main parts of the burner: thus, for instance, the condensates will naturally fall back into the vaporiser if the inlet for the vapour derived from the vaporiser is at a low point of the burner.

In the course of various tests that were carried out, it did in fact appear that the metal surfaces in contact with the fuel vapours constitute actual condensers, and in small capacity apparatus, these surfaces entail considerable recondensation rates in relation to the flow rate of vapour brought back into circulation. Communication between the vaporiser and the burner must be as short as possible. It is therefore desirable in this respect, to incorporate the section of the burner where the vapours are admitted, directly in the vaporiser cover. This portion should be as well lagged as the rest of the burner. Lagging of the diffuser on the other hand, is not absolutely necessary, for the mixture of air and fuel vapour is at a much lower temperature (of the order of 120° C.) and the partial pressure of fuel vapour is low (of the order of 10 mb), so that recondensation is less to be feared. On the other hand, the lagging material represents an additional weight to be reheated during starting and may lead to a prohibitive lengthening of the starting period. The absence or presence of lagging on the diffuser may therefore depend on the individual burner.

It has moreover been observed in the course of tests that a vaporiser of the type referred to above displays a certain inherent instability taking the form, when heated at constant output, of a production of vapour passing through maxima and minima in accordance with a periodic law. Now it has been found that this phenomenon disappears completely if the supply of liquid fuel takes place not in the downcomer conduit of the vaporiser, but in the riser where boiling is brought about and at its base. Nevertheless the feed at the low part of the vaporiser by a liquid whose density is smaller than that of the contents of the apparatus (which has already undergone incipient distillation) raises a problem of convective exchange in the supply piping of the two products. These exchanges again lead to instability. This problem is solved, in accordance with a preferred feature of the present invention by supplying the liquid fuel via a descending pipe, vertical, or with a large angle of inclination fed by a reserve, a pipe or merely a constant level tank from an altitude at least equal to half the level of liquid in the vaporiser. To avoid a direct percolation of vapour bubbles, emitted in the vaporiser through the supply pipe (which would not fail to involve blockage by the vapour plug of the feed pipe), the descending feed pipe is preferably connected with the vaporiser by a pipe of very low capacity and very slight slope; a very slight rising slope in the direction of flow is in fact necessary to further the flow of possible air bubbles.

According to an advantageous embodiment, a reserve of liquid is provided in the feed pipe, this reserve furnishing a fluid capacity that is able to fill the vaporiser entirely during stationary periods:

to limit the free section of liquid to that of the discharge pipe to cool slightly the vaporiser by a massive contribution of fresh fuel to prevent air from entering a vaporiser unit where the temperature exceeds 300° C.

This embodiment prevents the formation of resins and reduces almost to nil the emissions of hydrocarbons during stationary periods.

This container is emptied by blowing by means of a small auxiliary compressor. The liquid returns to this container on starting merely by the release of pressure. It is also possible to accommodate therein an element which is sensitive to temperature.

The burner is made of any suitable materials having no appreciable chemical activity to the point of furthering the formation of deposits.

It is also made substantially sealed so that no unpleasant smells can be perceived from outside.

The heating resistance of the fuel is calibrated so as to furnish a well-defined delivery of vaporised fuel. If electronic intensity regulation be added to it, modulated operation can be obtained.

Hydrocarbon emissions during the shutdown period can also be substantially eliminated by means of an electromagnetic or pneumatic valve which closes communication between the vapourizer and the diffuser.

The apparatus according to the invention, if dimensioned appropriately is preferably provided with all the necessary safeguards and a number of control means to ensure for it automatic operation, these means being well known to control experts in the art.

The invention is now illustrated by way of a number of non-limitative embodiments thereof given by way of example only, and with reference to the accompanying drawings, in which:

FIG. 1 is a side elevation of a burner according to the invention;

FIG. 1*a* is a plan view of the burner of FIG. 1;

FIG. 5 illustrates part of the burner of FIG. 1 with a fuel vapour control valve as a variant or additional feature.

FIG. 6 shows another type of fuel vapour control valve in the part shown in FIG. 5;

FIG. 7 is a view of part of the burner of FIG. 1 with a modified arrangement for introducing fuel vapour into an air stream passing to the burner;

FIG. 8 is a modification of the arrangement of FIG. 7;

FIG. 9 depicts schematically alternative means for providing stream of air in the burner of FIG. 1; and FIG. 10 shows a detail of the fuel feed system of the burner of FIG. 1.

Figure 1:
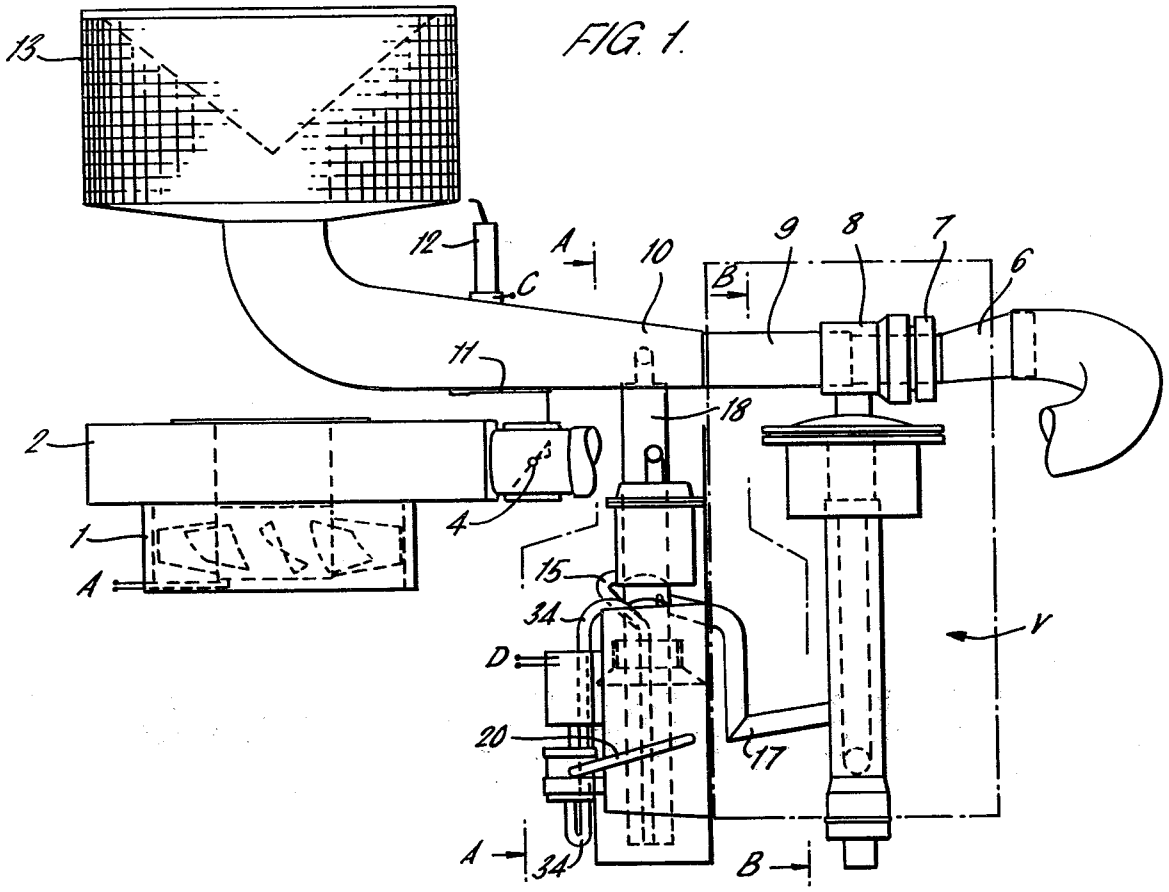

Referring first to FIGS. 1–4, the burner comprises an axial flow fan 1, electrically powered via terminals A, which operates to supply a stream of air substantially at atmospheric pressure or very slightly higher into a volute 2 from which it passes to a conduit 5 in which a flow regulating valve 4 is disposed. The position of the valve 4 is regulated by motor which is at least partly controlled by signals from terminals B. The air stream is conducted to a mixing zone 8 via a slightly convergent conduit section 6 attached thereto by a nut 7. Fuel vapour at a pressure exceeding the pressure of air in the mixing zone 8 passes into the outer annular region of the mixing zone 8 and is swept out of the mixing zone 8 by the stream of air, with which it mixes to a downstream duct section 9 and hence into the upstream end of a divergent diffuser 10 wherein some of the kinetic energy of the mixed air-fuel vapour stream is converted to pressure energy. The downstream end of diffuser 10 terminates in a flame stabilizer 13 and the mixed air-fuel vapour stream burns in a stable flame around the periphery of the stabilizer 13.

Figure 3:
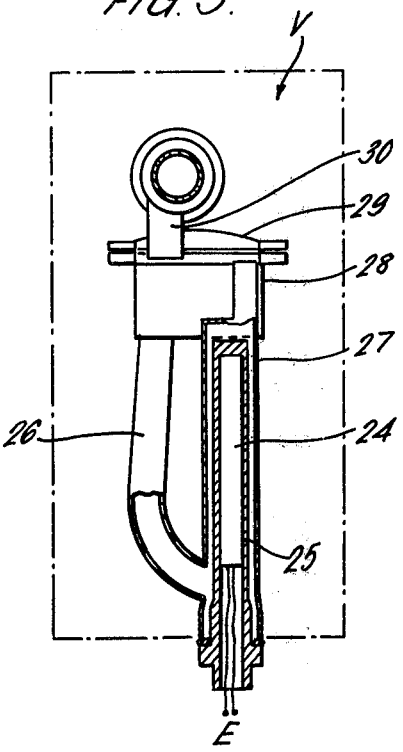
FIG. 3 is a side elevation of the vaporizer employed in the burner of FIG. 1, taken in the planes of line B—B of FIG. 1.

As will be seen from FIG. 3, in particular, the fuel vapour is generated in a vapourizer V of generally "U"-shaped configuration. The vapourizer comprises an upwardly extending riser 27 terminating at its top at one side of a separating chamber 28 and a downcomer 26 which extends downwardly from the diametrically opposite side of the chamber 28, the bottom of the downcomer 26 curving smoothly downwards into communication with a bottom region of the riser 27. The riser is of circular cross section, and a heating element 25 of circular cross-section extends upwardly in the riser 27 from the closed bottom thereof to near the top, and defines therewith an annular clearance of small radial width (e.g. 2–5 mms.). The heating element 25 is heated by an internal electrical heating resistance 24 supplied with electric power at terminals E. Liquid fuel is supplied to the vapourizer V from a fuel feed system via a conduit 17 which has a substantially vertical part terminating at the lower end of a short path which is upwardly sloped at a small angle to the horizontal, the upper end being connected into the riser 27 at just above the level at which the downcomer 26 communicates with the riser 27.

For operation, liquid fuel, preferably boiling in the range 150° C. to 400° C., is passed into the vapourizer V to a level slightly below the bottom of the chamber 28 and preferably slightly below the top of the heating element 25, the level being regulated by a level controlling system. When electric power is supplied via the terminals E, the skin temperature of the heating element rises and liquid fuel in the narrow annular space between the element 25 and the surrounding riser wall is heated. The lighter fractions of the liquid fuel eventually begin to vapourize and bubbles of vapour form in the liquid in the riser 27 thereby reducing the overall density of the liquid therein. The bubbles tend to rise in riser 27 and to promote an upward flow of liquid and vapourized fuel in riser 27. With the passage of a short time, the narrow annulus containing fuel in the riser 27, particularly towards the top end, tends to contain a foam of fuel vapour bubbles in liquid fuel and the fuel circulates upwardly into the chamber 28 where the fuel vapour separates from the liquid fuel. Unvapourized fuel circulates to the top of the downcomer 26, and cool fuel from the bottom of the downcomer circulates into the bottom of the riser 27. The fuel vapour rises in the chamber 28, initially giving up heat of vapourization and sensible heat to the chamber 28 and circulating to the downcomer 26, but eventually passing out of the vapourizer V via a relatively short tube 30 (attached to the cover plate 29 of the vapourizer) into the mixing zone 8 from where it is swept along by the air stream therein towards the burner head 13.

It is important to note that fuel vapour passes from the vapourizer V to the mixing zone 8 as a result of the continued generation of fuel vapour in the vapourizer V, possibly promoted by any slight excess of pressure over the pressure in the mixing zone. It will be appreciated that the vapourizer V, although integrated to operate and co-operate substantially in the optimum manner with other parts of the burner (as will be more fully explained below), is operative to generate fuel vapour independently of the presence of a flame at the burner head and independently of the supply of air from the fan 1. The air from fan 1, during operation, supplies no energy for the removal of fuel vapour from the vapourizer V, but merely sweeps the fuel vapour which has passed of its own accord into the mixing zone 8 towards the burner head. The air is preferably at atmospheric pressure, or thereabouts, and the fan 1 will therefore operate with relatively little noise, since the pressure drop across the fan is substantially zero. Correspondingly, the efficiency and power consumption of the fan 1 are respectively high and low. As fuel is vapourized, the amount of vapour in the vapourizer is substantially maintained by the introduction of fresh liquid fuel via conduit 17. Initially, some vapour will be condensed as heat is extracted therefrom by the cool surfaces of the duct section 9 and diffuser 10, but eventually fuel vapour reaches the burner head 13. The temperature immediately upstream of the head 13 is detected by element 11 and a temperature signal from element 11 is employed to adjust the opening and closing of the air flow regulating valve 4 so that the setting of the valve 4 is such that the amount of air is from 80% to 120% of the amount required for the complete combustion of the fuel vapour. For most domestic fuel oils, the fan 1 may be arranged to start at a temperature in the range of from 65° to 100° C. and the valve 4 may be open at temperatures in the range of from e.g. 120° C. to 200° C., as detected by element 11, and the valve 4 may be fully open at temperatures in the range of from, e.g., 240° C. to 360° C. when the burner is being operated at its maximum output, depending upon (inter alia) the amount of heat loss from the conduit 9 and diffuser 10. Preferably conduit 9 and diffuser 10 are lagged to reduce heat losses as far as possible.

The air-fuel vapour mixture, on reaching the burner head, is ignited by sparks passing from the electrode 12 which is at a high tension relative to the earthed burner head 13 during burner start-up, the high tension voltage being supplied via terminals C. The presence of a flame is determined by known flame ionization techniques, the flame ionization measurement being made between the electrode 12 and the head 13.

The burner head 13 is of any type employed for the combustion of gaseous fuels and is constructed to ensure that the flame velocity is not less than the velocity of the air-fuel vapour mixture passing into the base of the flame. During operation, the flame burns mainly around the cylindrical periphery of the head 13. The signals from the temperature sensitive element 11 are arranged to operate the valve 4 so that the latter gradually opens to admit progressively larger air flows as the temperature at element 11 increases at start-up from cold and to maintain a substantially constant proportion of air to fuel vapour for substantially all the time the valve 4 is open, irrespective of the amount of fuel vapour produced by the vapourizer V to maintain a desired heat output from the flame at burner head 13. The element 11 may be a bimetallic strip or similar device which changes its shape and/or size in accordance with its temperature, and the element 11 may operate valve 4 at least partly mechanically. Alternatively, the element H may be a thermocouple or electrical resistance from which amplified electrical signals may be derived to determine the positioning of the valve 4 and to actuate the fan switch.

The mixing zone 8, conduit 9, diffuser 10 and conduit section 6 are slightly sloped downwards towards the vapourizer V so that any condensed fuel runs back into the vapourizer.

Figure 1A:
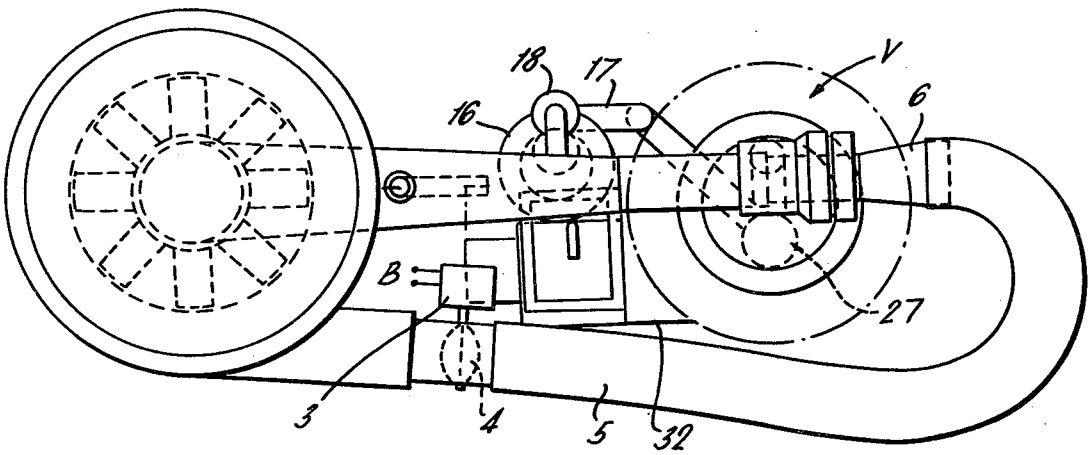
Figure 2:
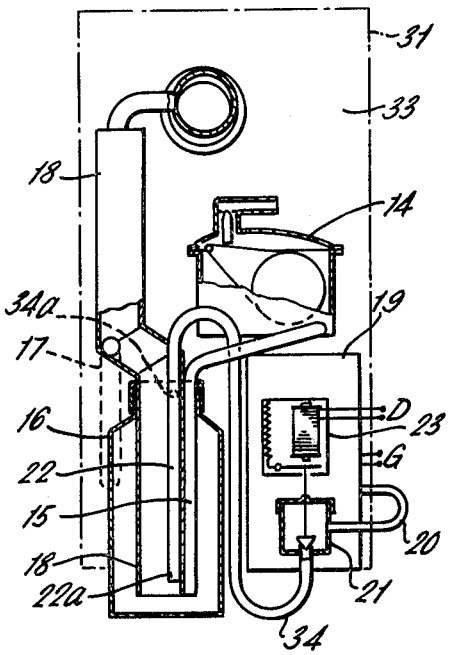
FIG. 2 is a side elevation of the fuel feed system of the burner of FIG. 1 taken in the planes of line A—A of FIG. 1.

The supply of fuel to the vapourizer V is from an integrated fuel feed system as shown in FIG. 2 in particular. The feed system is maintained in position by a plate 32 (see FIG. 1*a*) attached to the casing around the vapourizer, and comprises a constant level tank 14 of the type in which the level of a float determines the opening and closing of a needle valve.

The tank 14 supplies fuel to the vapourizer via a tube 17, optionally with means from flooding the vapourizer with cold liquid fuel between the tank 14 and the tube 17 as shown in FIGS. 1, 1*a* and 2. The tube 17 comprises a short portion which is upwardly sloped towards the vaporizer at a small angle to the horizontal, as will later be described with reference to FIG. 10 and communicates with the riser 27 preferably at about the same level as the level at which the downcomer 26 communicates therewith. The upward slope the portion of tube 17 prevents or at least reduces the risk of heated fuel circulating from the vapourizer into the tube 17, and also prevents the accumulation in tube 17 of slugs of fuel components having a high boiling point, such components tending to accumulate towards the bottom of the vapourizer due to the removal by vapourization of lighter components of lower boiling point. If the tube 17 periodically accommodates plugs of heavy fuel components, the feed of liquid fuel to the vapourizer will be non-uniform since from time-to-time the fuel feed entering the vapourizer will consist entirely of a slug of heavy, high boiling components and the quantity of fuel vapour produced by the vapourizer will temporarily diminish until the temperature in the riser 27 has risen to a temperature high enough to vapourize the fuel in the riser 27 with its higher proportion of high boiling components. Thereafter, the temperature of riser 27 will be excessively high for the liquid feed of normal composition passing to the vapourizer to vapourize at the rate prevailing before the time of entry of the high boiling slug, and the vapourization rate will be relatively high for a period of time until equilibrium is re-established. The upward slope of the portion of tube 17 is therefore important for maintaining stability of operation of the burner without variations in the characteristics of the flame at the burner head 13.

The means for flooding the vapourizer with cold liquid fuel comprises a container 16 having sufficient liquid fuel capacity for filling the vapourizer V to a level just above the bottom of the tube 30, and an upwardly extending tube 18 around a bottom portion of which the top of the container 16 is sealed. The bottom of the tube 18 is open within the container 16 and the top portion of tube 18 is offset from the bottom portion and communicates with a region of the combustion air ducting (e.g. a region of the diffuser 10) at which the static pressure is substantially equal to atmospheric pressure so that the pressure above liquid fuel in the container 16 and tube 18 is substantially atmospheric without there being any direct communication with the atmosphere so that fuel cannot be vented directly to the atmosphere from the container 16 and tube 18.

Fuel is supplied to the interior of the bottom portion of tube 18 and thereby to container 16 via line 15 and circulates out of tube 18 via the top portion of tube 17 at a level which is at least equal to, and preferably higher than, a level half-way between the bottom level and upper level of liquid in the vapourizer V. The top portion of the tube 17 extends downwardly at a steep angle to its junction with the upwardly sloped bottom portion of the tube in order to facilitate the discharge of any air bubbles therein to the tube 18. The steep angle is preferably at least 45° to the horizontal, and more preferably substantially 90° where the arrangement of the items of equipment of the burner permit.

When it is desired to stop the burner, the vapourizer V is flooded with cold liquid fuel from container 16 until there is some liquid fuel in the tube 30, the supply of electrical power at the terminals E having first been interrupted. The cold liquid fuel, when mixed with the heated fuel in the vapourizer, reduces the temperature of the resulting mixture of cold and heated fuel to below the boiling point of substantially all the fuel components and the low surface area of liquid in tube 30 further reduces the amount of vapour which can escape via tube 30 to the mixing region 8. Accordingly, the supply of fuel vapour passing to the burner head 13 is substantially interrupted and the flame at head 13 is extinquished when the air stream sweeps the last portions of fuel vapour from the mixing zone to the burner head.

The flooding of the vapourizer V is effected by displacing liquid fuel out of container 16 by compressed air. The compressed air is provided by a compressor 19, electrically powered from terminals G, and the compressed air passed via tube 20 to a valve chamber having a valve 21 for regulating the outflow of compressed air. The valve 21 is spring biassed towards a normally closed position and is opened on supplying electrical power to the electromagnet 23 at terminals D. When valve 21 is open, compressed air passes into tube 34 and then into the top of tube 22. The tube 22 has an upper orifice 34a communicating with the space between the container 16 and the bottom portion of tube 18 and a lower orifice 22a spaced above the base of the container 16 and communicating directly with a lower region of the bottom portion of tube 18. While the level of liquid in container 16 is above the level of lower orifice 22a, the compressed air passes into the space between the container 16 and the bottom portion of tube 18 so as to raise the level of liquid fuel in tube 18 to a level above the bottom of tube 30, liquid fuel then circulating to the vapourizer via tube 17 until the level of liquid fuel in container 16 is substantially at the level of lower orifice 22a, whereupon no further liquid can be displaced since the compressed air then passes out of orifice 22a into diffuser 10 by passage up tube 18. The volume of liquid fuel displaced from container 16 between the level set by the level regulating tank 14 and the level of the orifice 22a is sufficient to raise the level of liquid in the vapourizer to above the buttom of tube 30. It is preferred that liquid be displaced into the vapourizer V rather slowly at first, and then as fast as the equipment permits since it has been noted that if the liquid fuel is passed into the hot vapourizer initially at a high rate, the rate of production of vapour tends to increase very rapidly and the size of the flame temporarily increases considerably. To regulate the flow of compressed air, the valve 21 may have a profile which is narrow at the tip and relatively wide away from the tip, the valve 21 being moved upwardly initially to permit a small air flow around the wide profile, and then to permit a larger air flow around the narrow part of the profile. Alternatively, any suitable programming means may be employed to regulate the flow of air, e.g. by controlling the movement of the valve 21. When the flow of air ceases and air is vented from, e.g. the valve chamber, liquid fuel returns via pipe 17 at container 16 until the level in the vapourizer V and tube 18 is substantially the level determined by the level regulating tank 14.

The burner of FIGS. 1 to 3 is formed from a number of detachable assembles to permit cleaning and maintenance. Thus, the air ducting is in two parts detachably fastened by nut 7, the vapourizer comprises a detachable cover 29 and a removable heating bar 25, the container 16 is detachably secured to the lower portion of tube 8, and the cover of the constant level tank can be removed. Suitable seals are employed to prevent leakages inwardly to, or outwardly of, the equipment. The parts of the burner which are hot, during use, are lagged and encased in, e.g. stainless steel.

Figure 4:
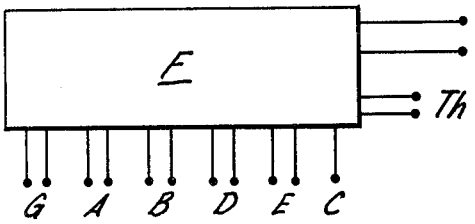
FIG. 4 is a schematic drawing of part of the control equipment of the burner of FIG. 1.

The starting and stopping sequence of the burner is controlled by box F of FIG. 4 which contains known means for effecting the required operations. The burner may be automatically controlled by signals from a thermostat Th. When the signals indicate a demand for heat, power is supplied to terminals A to operate the fan, to terminals B to permit the valve 4 to respond to signals from element 11 and to terminals E to heat the heater bar 24. The power initially supplied to terminals E may be greater than the power supplied during operation. After a predetermined time, power is supplied to the terminals C to ignite the air-fuel vapour mixture, the power being interrupted when a flame is detected. Known equipment may be provided for supplying power to the terminals C to ignite the mixture on accidental flame extinction, or for other safety measures.

When the thermocouple Th indicates that the heat demand is satisfied, the power at terminals E is reduced or interrupted and if the burner is to be shut down, power is supplied at terminals D to operate the compressor 19 and then to terminals B to cause the compressed air valve 21 to open according to a programme. When the temperature-responsive valve 4 is closed, power to terminals B is cut off so that the valve remains closed, and power to terminals A is interrupted so that the fan 1 stops. It will be appreciated that the burner output may be modulated by varying the power supplied at terminals E.

In one example of a burner, as illustrated in FIGS. 1 to 3,—consuming a maximum of 1.5 Kg/hour of commercial domestic fuel oil having a lower calorific value of 10,250 Kcal/Kg and other characteristics as follows:

| | | |
|---|---|---|
| specific gravity | | 0.827 @ 15° C. |
| viscosity | | 3.60 cSt @ 20° C. |
| distillation (ASTM) | | |
| 10 vol. % distilled at | 175° C. | |
| 50 vol. % distilled at | 260° C. | |
| 90 vol. % distilled at | 353° C. | |

An electrical power consumption of about 325 W was used for vapourizing the fuel at a rate of 1 Kg/hr. in the vapourizer V which had a temperature of about 350° C., and an additional 25 W for the fan 1 (max. output pressure about 40 mms $H_2O$ at zero flow, and up to 5 mms $H_2O$ during normal use) and ancillaries. The heat output from the burner was about 10 KW. The burner started from cold in under 4 minutes with a preheating power of 600 W to the vapourizer, and in cyclic operation with interruptions not exceeding 10 minutes it started again in about 45 seconds. The total flow area through the burner head was 30 $cm^2$ and the flame was blue and stable with a total absence of yellow spikes. The combustion gases were composed of:

| | |
|---|---|
| $CO_2$ | 15.2% |
| $O_2$ | 0.5% |
| CO | traces |
| $NO_x$ | 200 ppm. |

The noise level of the assembly was about 40 dB on the international "A" scale.

It will be seen that the vapourizer has openings only for cold liquid fuel and for the escape of fuel vapour under its autogeneous pressure. No additional power (and hence noise) from the fan is required to aspirate or pump the fuel vapour from the vapourizer, and no hot and/or oxidizing gases, which cause liquid fuels to degrade to deposit-forming materials, enter the vapourizer.

In FIG. 5 is shown a valve member which can be set to two positions only by an actuator above the mixing zone 8. When the burner is operating, the valve member is lifted from the top of the fuel vapour tube 30 and when the burner is shut down, the valve mamber is sealed on the top of tube 30 to prevent the escape of fuel vapour. The pressure buildup in the vapourizer on seating the valve member is relatively low, particularly as the movement of the valve member between its two positions is coordinated with the supply and interruption of power to the vapourizer. FIG. 6 shows a similar arrangement, but the valve member is a flap valve which can assume two positions only.

In FIG. 7, the fuel vapour passes from vapourizer chamber 28 to the mixing zone via a tube 130 which is attached to the mixing zone and which is arranged to deliver the fuel vapour to the central region of the mixing zone and directed downstream. The fuel vapour tends to condense and deposit less on the walls of the mixing zone and diffuser 9 than in the arrangement shown in FIGS. 1 to 3. FIG. 8 depicts an arrangement for interrupting the supply of fuel vapour from tube 130. The tube 130 terminates at a vapour supply tube which extends perpendicularly to tube 130 and substantially co-axially with conduit 9. The downstream end of the supply tube is open for the delivery of vapour but the upstream end is blocked by a hollow slide valve which is spring urged towards a position in which it closes off the top of tube 130. The slide valve is maintained in a retracted position against the spring bias by the supply of power to a solenoid coil. The solenoid coil and spring are preferably located outside the air and fuel vapour ducting for ease of maintenance.

When the burner output is designed to provide a very small heat output, it may be difficult to match the air supply rate to the low fuel vapour rate using a centrifugal fan of the paddle or squirrel cage type. The problem may be solved by employing a low output, relatively high pressure air pump which delivers its air to the open end of a jet pump so as to induce atmospheric air, the resulting air stream passing to the conduit 5 at substantially atmospheric pressure. In this arrangement, the air pump noise is at a relatively low level due to the very small size of the air pump.

As previously stated, the angle (alpha) of upward slope of the tube 17 supplying liquid fuel to the riser 27 of the vapourizer must be such as to avoid the formation of slugs of high boiling components therein which would otherwise impair the stability of burner operation.

With reference to FIG. 10, the tube 17 has an internal vertical diameter h and an upper side of internal length l. In order to avoid the formation of accumulations of heavy fuel components which completely obstruct the elbow in tube 17, the following relationship is preferably observed:

$$\text{Arc. sin } d/21 < \text{alpha} < \text{Arc sin } d/1$$

In order to facilitate the discharge of air bubbles, the downcomer portion of tube 17 should preferably be inclined at an angle beta to the horizontal not less than 45° and preferably 90°.

The various arrangements depicted in FIGS. 1 to 3 and 5 to 9 may be employed in any technical feasible combination.

What we claim is:

1. A burner for burning liquid fuel comprising: a burner head at which the fuel is burned with air in a substantially stable flame; air supply means operable to supply a stream of combustion air at substantially atmospheric pressure; an air supply conduit comprising a mixing region and a divergent diffuser for conducting said stream of combustion air from said air supply means to the burner head during operation of said air supply means; means for supplying liquid fuel to said burner; a vapourizer for receiving said liquid fuel and converting said liquid fuel to fuel vapour remote from and out of contact with said combustion air stream and at a pressure at least equal to the operating pressure at said selected mixing region of the conduit, the vapourizer comprising liquid fuel heating means operable to vapourize said liquid fuel substantially at atmospheric pressure independently of the presence of any flame at the burner head; and a tube for conducting fuel vapour from the vapourizer to said selected mixing region of the conduit, being constructed and arranged relative to said conduit such that during operation the fuel vapour passes into said mixing region and is swept from said mixing region by said combustion air stream with which said fuel vapour mixes to form a substantially uniform mixture of air and fuel vapour in said conduit for subsequent burning at said burner head.

2. A burner according to claim 1 in which the vapourizer includes an inlet orifice for the supply of liquid fuel and an outlet orifice operably connected with said tube for supplying substantially undiluted fuel vapour to said mixing region.

3. A burner according to claim 1 comprising regulating means for regulating the flow rate of air from said air supply means to said mixing region of the conduit, and control means responsive to the temperature of air and fuel vapour mixture passing to the burner head for adjusting the regulating means such that the rate of flow of air is maintained in the range of from 80 to 120% of the air required for complete combustion of the fuel vapour passing to the burner head.

4. A burner according to claim 1 wherein said liquid fuel supply means comprises a container, means for maintaining a constant level of liquid fuel in the container, and a liquid fuel supply conduit connecting the container to the vapouriser.

5. A burner according to claim 4 in which the liquid fuel supply conduit comprises a first conduit portion of length 1 and vertical internal height h connected at one end to the vapourizer and connected at the other end to one end of a second conduit portion which communicates, at its other end, with said container, the first conduit portion having a upward slope towards the vapourizer at an angle alpha to the horizontal wherein alpha has a value not less than arc tan $h/2 \times 1$.

6. A burner according to claim 5 in which the second conduit portion extends upwardly at an angle to the horizontal of at least 45°.

7. A burner according to claim 4 in which the constant level means is constructed and arranged to maintain a level of liquid fuel at least halfway between the top and bottom of the volume for containing liquid in the vapourizer.

8. A burner according to claim 4 in which the volume of liquid fuel containable by the container is at least sufficient for reducing the temperature of liquid fuel in the vapourizer, when mixed with heated fuel in the vapourizer, to a temperature at which substantially no vapour is generated in the vapourizer.

9. A burner according to claim 8 comprising means operable to displace said volume of liquid fuel from the container to the vapourizer.

10. A burner according to claim 4 in which the the volume of fuel containable by the container is at least sufficient to fill the vapourizer substantially to the level of the disengaging chamber.

11. A burner according to claim 1 in which the vapourizer comprises a substantially vertical riser conduit arranged side-by-side with a substantially vertical downcomer conduit, the riser conduit and downcomer conduit communicating with each other substantially at their bottoms, a disengaging chamber connecting the tops of the riser and downcomer conduits for the disengagement of fuel vapour from liquid fuel, said tube providing communication between the chamber and the mixing region of the said conduit, heating means in said riser conduit defining with the internal wall thereof a relatively narrow substantially vertical space for the upward circulation of a mixture of liquid and vapourized fuel generated by the action of the heating means, on liquid fuel when in the vapourizer.

12. A burner according to claim 11 in which the inlet for fuel to the vapourizer is at a bottom zone of the riser conduit.

13. A burner according to any one of claim 1 comprising valve means operable to close the fuel vapour-conducting tube to prevent the passage of vapour from the vapourizer to the mixing region of the air conduit.

14. A burner according to claim 1 in which the fuel vapour-conducting tube terminates substantially coaxially with the axis of the mixing region of the air supply conduit whereby during operation of the burner, fuel vapour passes into the mixing region substantially coaxially thereof.

15. A burner according to claim 1 having a heat output not exceeding 50 KW.

* * * * *